United States Patent [19]

Peretz

[11] Patent Number: 4,589,556

[45] Date of Patent: May 20, 1986

[54] HOLDER ASSEMBLY FOR STEMMED GLASSWARE AND LIKE OBJECTS

[76] Inventor: Steven I. Peretz, 258 NE. 27 St., Miami, Fla. 33137

[21] Appl. No.: 740,364

[22] Filed: Jun. 3, 1985

[51] Int. Cl.[4] ..... A47F 5/01

[52] U.S. Cl. ..... 211/41; D7/71; 211/71; 211/181; 248/310; 248/311.3

[58] Field of Search ..... 211/41, 71, 181, 74; 248/311.2, 311.3, 312, 313, 310; D7/71

[56] References Cited

U.S. PATENT DOCUMENTS

| | | | |
|---|---|---|---|
| 1,925,540 | 9/1933 | Neuschotz | 248/313 |
| 3,214,031 | 10/1965 | McCauley | D7/71 X |
| 3,258,127 | 6/1966 | Cushing | 211/41 |
| 3,612,285 | 10/1971 | Mason | 211/41 |

*Primary Examiner*—Robert W. Gibson, Jr.
*Attorney, Agent, or Firm*—John Cyril Malloy

[57] ABSTRACT

A holder assembly specifically designed to removably mount one or more long stemmed articles such as stemmed glassware on a conventional dish supporting rack of a dishwasher in a manner such that the stemmed article will not be inadvertently dislodged from the holder assembly during force applied thereto by jets of water during the cleaning operation. A base is dimensioned and configured to support one or more gripping assemblies through interconnection of stanchion elements such that the gripping assemblies are disposed above the base and the rack on which they are mounted. Each one or more of the gripping assemblies is structured to removably engage, in a clamp-like manner, the base of the stemmed article. The article is thereby oriented in an inverted, preferred position which exposes the interior of the glass as well as other portions thereof to the cleansing jets of water being dispersed on the interior of the conventional dishwasher.

20 Claims, 4 Drawing Figures

HOLDER ASSEMBLY FOR STEMMED GLASSWARE AND LIKE OBJECTS

BACKGROUND OF THE INVENTION

1. Field of the Invention

This invention is directed towards a holder assembly specifically designed to hold one or more stemmed articles such as but not limited to long stemmed glassware, in a preferred inverted orientation so as to be securely positionable on the interior of a conventional dishwasher without fear of breakage due to inadvertent detachment thereof from the subject holder assembly.

2. Description of the Prior Art

In recent years the inconvenience of doing dishes by hand has been alleviated by the commercial availability of modern-day dishwashing machines primarily designed to be installed in the average residence. Generally, such dishwashing machines include one or two dish supporting racks specifically designed to have removably mounted thereon various types of glass and dishware. The structural components of these dish supporting racks normally include wire rods covered with a soft protective material to prevent scratching and/or abrasion to the objects being held. These stringers or wire rods are arranged in a variety of cooperative configurations such that plates, glasses, flatware, pots, pans, etc. all may be loaded into the dishwasher and oriented for exposure to the cleansing jets of water and detergent dispersed by proper fluid delivery means.

While the increased popularity of such automatic dishwashers is evidence of their general acceptance by the consuming public, it is still universally recognized that certain objects, particularly glassware and dishes of fragile design and/or structure are best washed by hand in order to avoid breakage. Such breakage normally occurs because the structural components or portions of the wire rack used to support glasses and dishes during the cleansing operation, as set forth above, are not specifically designed to hold certain articles. For example, long stemmed glassware and like stemmed articles are frequently difficult and sometimes impossible to properly position on these conventional dish supporting racks in a manner which will minimize the possibility of breakage but yet still orient the stemmed articles in a position which will insure proper cleaning thereof during the washing cycle.

Numerous U.S. Patents exist disclosing various structures in the prior art which are specifically designed to hold selected articles for purposes of display, storage, etc. However, these holding devices or racks are not generally capable of maintaining delicate articles, such as long stemmed glassware, in a preferred cleaning position on the interior of a modern-day dishwasher during the cleaning or washing cycle.

The following U.S. Patents are representative of prior art structures specifically adapted to hold articles of various types and configurations: U.S. Pat. Nos. Reichelt, 746,878; Greenwood, 945,520; Baldwin, 1,467,082; Caldwell, 2,491,891; Planeta, 2,708,037; Webster, 2,801,609; Jungholm, 2,227,886; Marasigan, 2,629,498; Feser, 2,951,590; Monet, 3,870,154.In addition to the above, the patent to Neuschotz, U.S. Pat. No. 1,925,540 discloses a brace or rack specifically designed to hold long stemmed glasses or like stemmed articles but which is primarily intended to maintain such stemware in a stored position in order to provide additional counter space or tabletop space for other uses.

Moreover, it is highly questionable if a structure of the type disclosed in the Neuschotz patent is capable of gripping the glassware securely enough to withstand the dynamic forces present in an operating dishwasher. None of the patents set forth above are directed to a structure intended to securely and removably position stemmed articles on a dish supporting rack of a modern-day dishwasher.

SUMMARY OF THE INVENTION

The present invention is directed towards a holder assembly of the type designed to securely but removably mount long stemmed articles, such as glassware, within a modern-day dishwasher. More specifically, the holder assembly of the present invention comprises a gripping means including a supporting portion having a generally bifurcated construction and designed to detachably support one exposed surface of the base portion of the stemmed article or glassware such that the stemmed portion is substantially surrounded by the bifurcated construction of the supporting portion of the gripping means.

The gripping means further includes a retaining portion designed to engage the opposite surface of the base of the stemmed article in a manner such that the base of the stemmed article is substantially sandwiched or wedged between the supporting portion and the retaining portion. An object entrance is defined at the spaced apart, open distal ends of the supporting portion and retaining portion. This object entrance is particularly dimensioned and configured to allow passage therethrough of the base portion.

A retaining lip is defined at the distal extremity of the retaining portion and comprises a closed peripheral extremity thereof which depends downwardly into at least partially obstructing position relative to the object entrance. This downward or depending projection of the retaining lip serves to block inadvertent removal of the base portion of the stemmed article from passage through the object entrance and removal from the individual gripping means.

A base means is attached at the lower end of the holder assembly and is specifically configured and structured to provide stable support of the entire holder assembly on the conventional rack of a modern-day dishwasher. In one embodiment of the present invention, the base means is integrally formed on the wire stringers or component of the rack so as to essentially form a part thereof.

Stanchion means in the form of at least two spaced apart stanchion at opposite ends of the base means are provided in upstanding and substantially parallel relation to one another. The stanchion means further comprises a connecting brace disposed in interconnecting relation between the spaced apart stanchion element. One or more of the aforementioned gripping assemblies may be secured to the connecting brace and extend outwardly therefrom wherein the supporting portion and retaining portion are mounted or connected to the connecting brace at what may be considered an adjacent junction. The aforementioned sandwich-type or wedge-type clamping action on the base portion of the stemmed glassware is in part provided by the divergent, spaced apart relation of the supporting portion to the base portion in each of the gripping means whereby the base portion and retaining portion include an inherent flexibility and bias which provides the clamping action on the base portion on the stemmed glassware when the latter is forced therebetween.

BRIEF DESCRIPTION OF THE DRAWINGS

For a fuller understanding of the nature of the present invention, reference should be had to the following detailed description taken in connection with the accompanying drawings, in which.

Like reference characters refer to like parts throughout the several views of the drawings.

DETAILED DESCRIPTION OF THE PREFERRED EMBODIMENT

Figure 2:
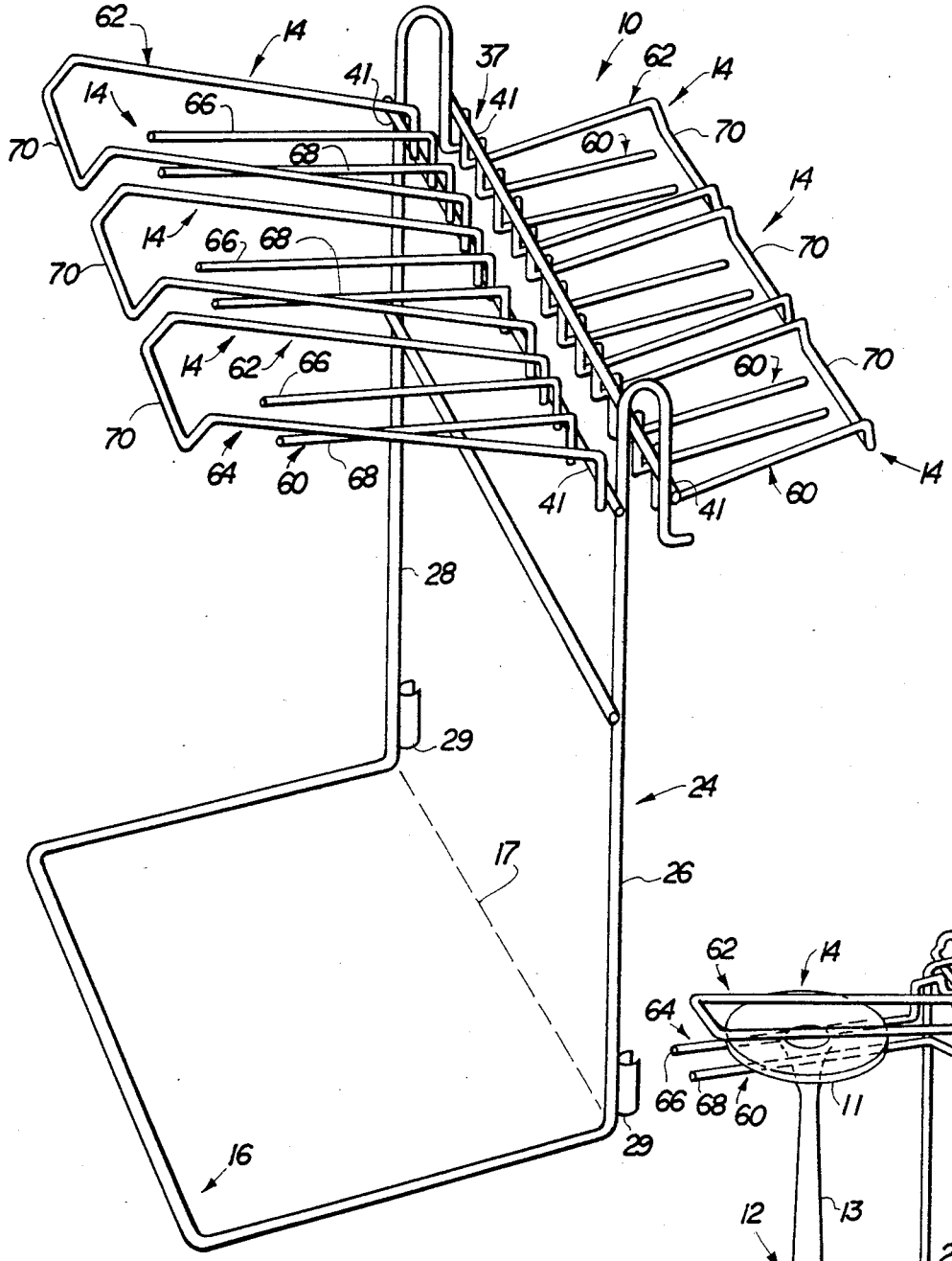
FIG. 2 is another embodiment of the present invention showing a plurality of gripping assemblies supported by a common base and stanchion assembly.
Figure 1:
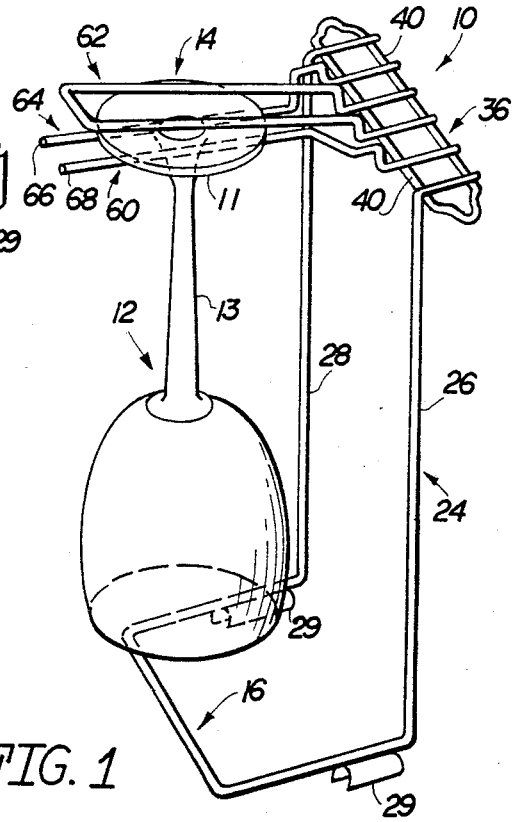
FIG. 1 is a perspective view of one embodiment of the holder assembly of the present invention with a stemmed article, such as glssware, mounted thereon.
Figure 3:
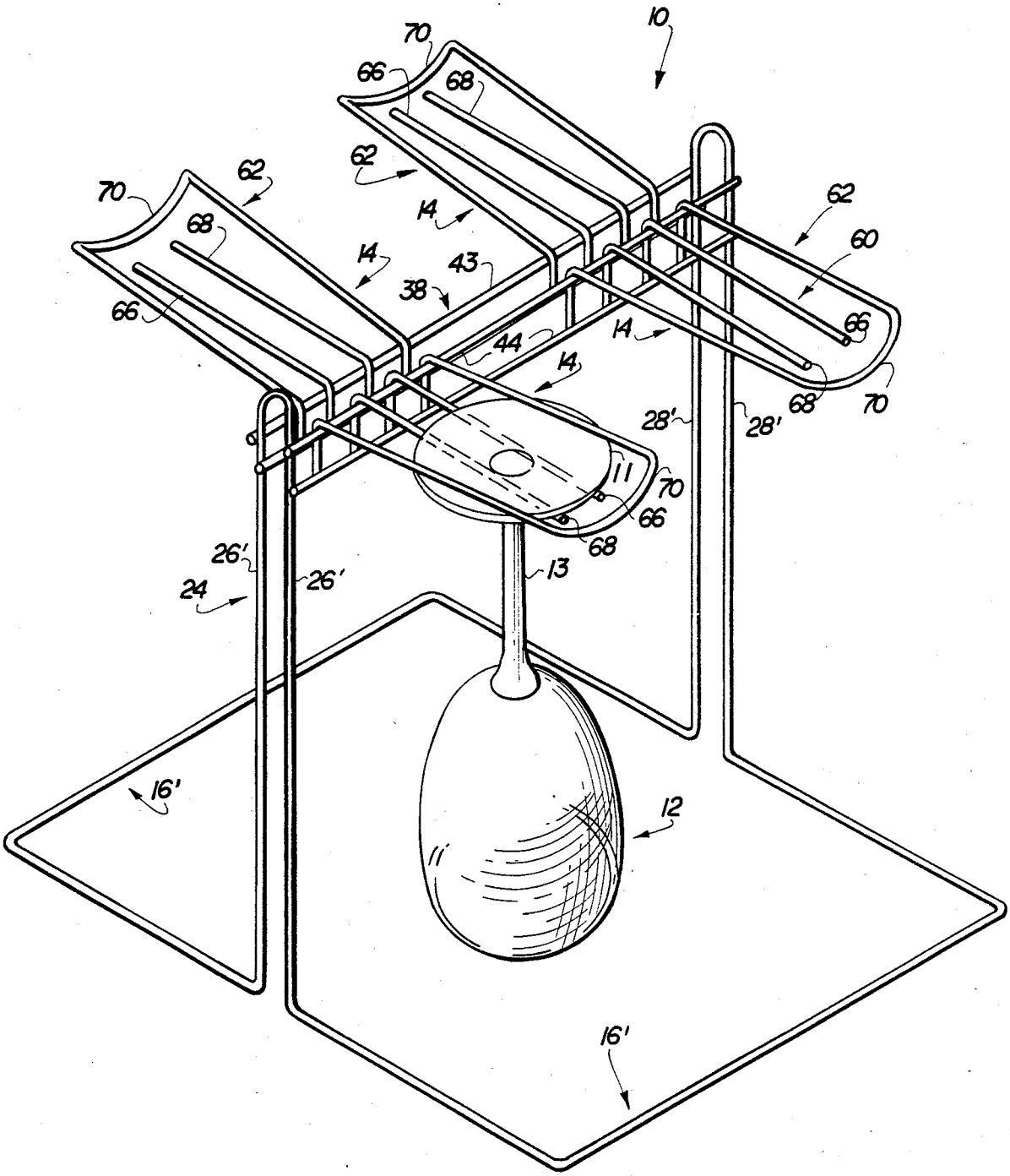
FIG. 3 is a perspective view of yet another embodiment of the present invention with supported glass stemware thereon.

As shown in the embodiments of FIGS. 1 through 4, the holder assembly generally indicated as 10 comprises a gripping means for removably supporting and mounting a stemmed article 12 in a preferably offset and inverted fashion to accomplish washing thereof during the washing cycle of a conventional automatic dishwasher. The gripping means includes one or more gripping assemblies 14 supported by and in overlying relation to a base means 16. The base means is specifically structured for mounting on a conventional rack 18 (see FIG. 4) of a conventional dishwasher. The base means 16 preferably includes a single wire or like material rigid structure surrounded by a protective coating of plastic or like material which is similar to the construction of the stringers 19 and 20 which form the dish supporting rack 18. In the embodiments of FIGS. 1 and 2, the base means 16 extends outwardly in a substantially planar configuration from stanchion means 24 in the form of two upstanding stanchion elements 26 and 28. More specifically, the base means 16 extends outwardly from an imaginary straight line interconnection represented by the imaginary line 17 a sufficient distance, and in certain embodiments, a distance at least equal to the distance of outward extension of one or a plurality of gripping assemblies 14. This outward extension and interconnection of base means 16 to the lower portion of the stanchion elements 26 and 28 serves to provide stability to the holder assembly when it is positioned on a supporting surface represented by the rack 18 of the dishwasher 21. Similarly, as shown in FIG. 3, the base means 16' extends outwardly from opposite sides of the holder assembly 10 particularly in light of the fact that a plurality of gripping assemblies 14 also extend outwardly from opposite sides of the stanchion means 24 to be described in greater detail hereinafter.

Figure 4:
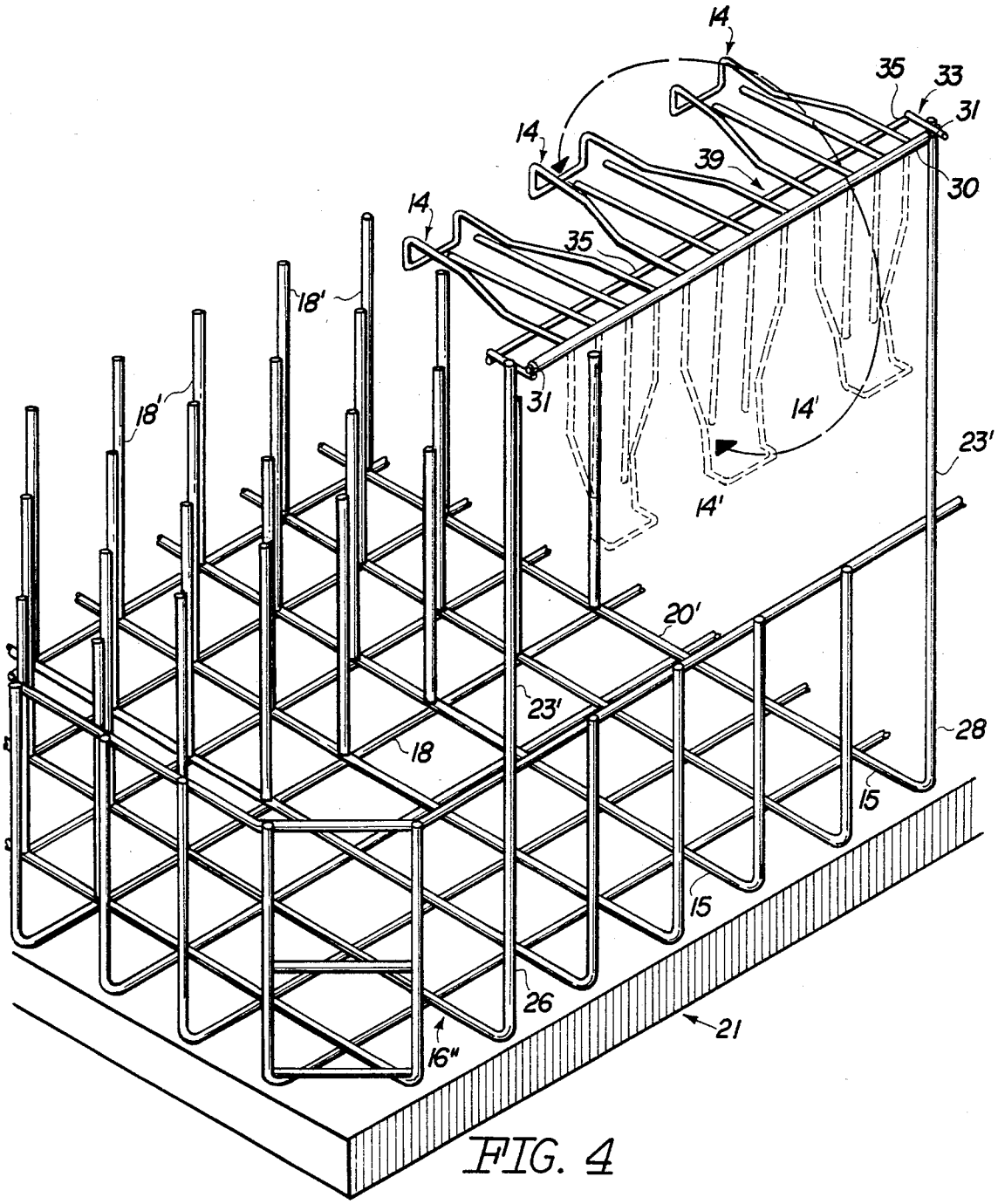
FIG. 4 is a perspective view of yet another embodiment of the present invention wherein the holder assembly of the present invention is integrally formed or connected to a substantially conventional dish supporting rack of a modern-day dishwasher.

Further with regard to the embodiments of FIGS. 1 and 2, a connecting element 29 is secured to the holder assembly either to the upstanding stanchion elements 26, 28 (FIG. 2) or to the base means itself 16 (FIG. 1). Each of the connector assemblies 29 are specifically adapted for detachable connection of the holder assembly to one of the stringer elements including cross stringers 19 and 20 representing the supporting surface of rack 18 or to the upstanding side stringers 23 (FIG. 4). By virtue of the provision of the connector assemblies 29, the base means 16 may be disposed and structured to extend outwardly from only a single side of the holder assembly 10 regardless of whether the gripping assemblies 14 extend from a single side or from both sides of the stanchion means 24. The specific structural features of each connector assembly may vary but each is generally formed from a flexible material capable of being widened at the entrance thereof for insertion and removal of one of the stringers 19, 20 and/or 23 defining the rack 18 of the dishwasher 21.

Another embodiment of the base means is represented in FIG. 4 and comprises the base means 16'' including stringers 15 which are integrally formed or connected to stringers 20' of the rack 18 of the dishwasher 21. Similarly, stanchion elements 26 and 28 are integrally formed or connected to the rack stringers 23'. In this embodiment, the holder assembly 10 is originally manufactured and/or constructed as part of the rack 18 and is supplied with the dishwasher. Further, in this embodiment the gripping assemblies 14 are capable of being selectively positioned between an operative and a stored position. The operative position is shown in solid line in FIG. 4. Placement of the gripping assemblies into the inoperative position 14', represented by broken lines, is accomplished by each of the assemblies 14 being fixedly secured so as to rotate with a hinge shaft 30 which in turn has its opposite ends 31 rotatable relative to support member generally indicated as 33. The support member 33 is secured at the upper end to stanchions 26 and 28 and further includes a stop member 35 which is positioned to interruptively engage and abut the under portions of gripping assemblies 14 so as to maintain them in an outwardly extended somewhat horizontal position. In such position, the stemmed wine glasses or like articles will be disposed in an inverted, somewhat offset orientation similar to that represented in FIG. 3. In a conventional fashion, the remainder of the rack 18 of dishwasher 21 may include specifically or conventionally configured and generally upwardly extending fingers 18' extending across the face of the rack 18.

In accordance with the embodiments of FIGS. 1 through 4 of the subject invention, the stanchion means 24 comprises upstanding stanchion elements 26 and 28 having their lower end interconnected by the outwardly extended base means 16 and 16'. The upper end of each stanchion element is interconnected by a connecting brace generally indicated as 36 (FIG. 1), 37 (FIG. 2), 38 (FIG. 3), and 39 (FIG. 4). The connecting brace 36 includes spaced apart brace elements 40 each of which are connected to proximal ends of a supporting portion 60 and a retaining portion 62 which at least partially define the gripping assembly 14. Similarly, connecting brace 37 comprises spaced apart brace elements 41 each of which support a plurality of gripping assemblies 14 so as to extend outwardly from opposite sides of the holder assembly as clearly depicted.

With regard to the embodiment of FIG. 3, the connecting brace 38 includes two pairs of brace elements 43 and 44 wherein each pair of brace elements serves to fixedly mount a plurality of gripping assemblies 14 in spaced apart relation to one another so as to extend in substantially parallel relation to one another outwardly from the connecting brace 38 in a common direction but from opposite sides of the holder assembly 10.

The connecting brace 39 of the embodiment of FIG. 4 comprises spaced apart brace elements 45 both of which are fixedly secured to adjacent connections or junctions of the respective supporting portions and retaining portions 60 and 62.

With regard to the various embodiments of the present invention (FIGS. 1 through 4), each of the gripping assemblies 14 include a supporting portion 60 and a retaining portion 62. As shown in each of the FIGS. 1 through 4, both the supporting portion 60 and the retaining portion 62 have a substantially elongated configuration and are spaced apart from one another, along their length, in a somewhat divergent fashion. Each of these portions are formed from a substantially flexible material which has an inherent bias. The divergent spacing allows a clamping action to be exerted on the base 11 of the stemmed article or glassware 12 when the base is forced in sandwiched-like relation between the supporting portion 60 and the retaining portion 62. The base 11 is forced in the position shown in FIGS. 1 and 3 by passing through an object entrance generally indicated as 64 formed by the spaced apart disposition of the distal ends of the supporting portion 60 and retaining portion 62. Further, the supporting portion 60 has a substantially bifurcated construction formed by spaced apart, elongated supporting elements 66 and 68 Each of the elements 66 and 68 have their distal extremities also spaced apart or open to allow passage between the elements of the stem portion 13 of the stemmed glassware 12. In this fashion, the stemmed article or glassware 12 is securely but removably mounted between the supporting portion 60 and the retaining portion 62 so as to be oriented in a somewhat inverted position to be properly cleaned. Further, the clamping action provided between the respective supporting and retaining portions is sufficient to prevent inadvertent dislodgement of the article 12 from any of the gripping assemblies 14 during contact with the cleansing water jets when the dishwashing machine 21 is operated. Further, as shown in FIGS. 2, 3 and 4, certain embodiments of the present invention contemplate the provision of a retaining lip 70 integrally formed on each of the retaining portions 62. The retaining lips are disposed in depending relation and at least partially define the distal extremity of each of the retaining portions 62 such that the peripheral edge of such distal extremity is defined by a continuous or substantially closed configuration which is overhanging or positioned in at least partially obstructing relation to the object entrance 64. This at least partially obstructing dispostion of the retining lip 70 serves to prevent inadvertent displacement of the base 11 of the stemmed article 12 from its supported position between the retaining portion 62 and the supporting portion 60 of the gripping assembly 14.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. A holder assembly for a stemmed object such as glassware and like articles, primarily designed to secure the article in a dishwasher in a preferred orientation for cleaning thereof, said holder assembly comprising:

(a) gripping means for securing a stemmed object in a preferred cleaning orientation and comprising at least one gripping assembly structured for detachable engagement with the stemmed object, (b) base means for support of said gripping means and being interconnected thereto and structured for securement of said holder assembly in substantially upstanding relation to a supporting surface, (c) stanchion means for interconnecting said gripping means to said base means in spaced and substantially overhanging relation thereto, (d) said one gripping assembly comprising a supporting portion and a retaining portion disposed in adjacent and spaced relation to one another and cooperatively structured and disposed to removably mount the stemmed object thereon, (e) said supporting portion structured to supportingly engage one side of a base of the stemmed object and said retaining portion disposed to engage an opposite side of the base, (f) said stanchion means being of sufficient longitudinal dimension to allow a substantially suspended orientation of the stemmed object in an inverted position facing said base means, (g) whereby the stemmed object is removably positionable within a dishwasher in a preferred orientation for cleaning thereof.

2. A holder assembly as in claim 1 wherein said supporting portion and said retaining portion each include a proximal end supported on said stanchion means at an adjacent connection relative to one another and extending outwardly therefrom in a substantially common direction and in spaced apart relation along their lengths, each of said respective portions including a distal end disposed in spaced relation to define an object entrance, said object entrance being sufficiently dimensioned to allow passage therethrough of the stemmed object.

3. A holder assembly as in claim 2 wherein said supporting and retaining portions are cooperatively positioned and dimensioned relative to each other and to said object entrance to define supporting engagement of the base of the stemmed object in sandwiched relation between said supporting and said retaining portions.

4. A holder assembly as in claim 3 wherein each of said supporting and retaining portions extend outwardly from said adjacent connection in substantially divergent relation to one another and each such portion structured to include an inherent bias which defines a clamping action exterted on the base of the stemmed object.

5. A holder assembly as in claim 2 wherein said supporting portion comprises a bifurcated construction defined in part by at least two finger elements extending outwardly from said stanchion means, said finger elements each having an elongated configuration and being spaced apart from one another at commonly disposed proximal ends thereof and along at least a portion of their respective lengths a sufficient distance for passage therebetween of a stemmed portion of the stemmed object.

6. A holder assembly as in claim 5 wherein said supporting portion is disposed in underlying relation to said retaining portion and in supporting engageable relation to a normally exposed surface of the base of the stemmed object; said distal end of said retaining portion extending beyond and in overhanging relation to the correspondingly positioned proximal ends of said finger elements and in substantially retaining disposition to a stemmed object sandwiched between said supporting and retaining portions.

7. A holder assembly as in claim 5 wherein said retaining portion is disposed in overhanging relation to said supporting portion and comprises a retaining lip defining a distal extremity thereof, said retaining lip structured and configured in depending relation from the remainder of said retaining portion and substantially toward said supporting portion, said retaining lip further disposed in at least partially obstructing relation to said object entrance, whereby inadvertent removal of the stemmed object from said gripping means is obstructed.

8. A holder assembly as in claim 7 wherein said retaining lip is further defined by a substantially closed and continuous leading periphery extending across the length of said object entrance.

9. A holder assembly as in claim 1 wherein said stanchion means comprises at least two stanchion elements disposed in spaced apart relation to one another along the length of said base means and each extending upwardly from said base means a sufficient distance to permit depending support of the stemmed object from said gripping means, said stanchion means further comprising a connection brace disposed in interconnecting relation between said stanchion element and in supporting relation to said gripping means.

10. A holder assembly as in claim 9 wherein said two stanchion elements are disposed in substantially parallel relation to one another and said connecting brace attached to each of said stanchion elements in a substantially straight line configuration, said supporting and said retaining portions mounted at their respective proximal ends to said connecting brace at an adjacent connection relative to one another and each extending outwardly therefrom in a substantially common direction.

11. A holder assembly as in claim 10 wherein said one gripping assembly extends outwardly from said connecting brace in substantially perpendicular relation to a plane defined by said parallel stanchion element and substantially parallel to and spaced above said base means.

12. A holder assembly as in claim 10 wherein said gripping means comprises a plurality of said gripping assemblies each mounted on said connecting brace and extending outwardly therefrom in spaced relation to one another along the length of said connecting brace.

13. A holder assembly as in claim 12 wherein said plurality of gripping assemblies extend outwardly from opposite sides of said connecting brace, said gripping assemblies of each side being disposed in substantially equally spaced apart and parallel relation to one another.

14. A holder assembly as in claim 9 wherein said base means interconnects said stanchion elements and extends outwardly and away from a straight line attachment therebetween a sufficient distance to provide a stable support for said upwardly extending and overlying gripping means and any stemmed object mounted thereon.

15. A holder assembly as in claim 14 wherein said base is structured to be removably mounted on a dish supporting rack of a dishwasher.

16. A holder assembly as in claim 15 further comprising a connecting assembly secured to said base means and structured to detachably connect said base means to the dish supporting rack of a dishwasher.

17. A holder assembly as in claim 15 further comprising a connecting assembly secured to said stanchion means and structured to detachably connect said stanchion means to the dish supporting rack of a dishwasher.

18. A holder assembly as in claim 9 wherein said base means is integrally formed on and comprises a part of a supporting rack within a dishwasher.

19. A holder assembly as in claim 18 wherein said stanchion elements extend upwardly from said integrally formed base means in attached and supported relation to the supporting rack, said stanchion means structured for selective positioning of said gripping means between a collapsed, inoperative position and an upstanding, operative position.

20. A holder assembly as in claim 15 wherein said stanchion means includes a pivot assembly disposed in interconnecting relation between said stanchion means and said base means and structured to allow pivotal displacement of said stanchion means and attached gripping means from said upstanding, operative position into said collapsed, inoperative position.

* * * * *